US005342267A

United States Patent [19]

Adams et al.

[11] Patent Number: 5,342,267

[45] Date of Patent: Aug. 30, 1994

[54] STRIKING DEVICE

[76] Inventors: Ronald L. Adams, 809 Cheryl Sue Dr.; James E. Blomquist, 840 Christy Dr., both of Riverton, Wyo. 82501

[21] Appl. No.: 93,475

[22] Filed: Jul. 19, 1993

[51] Int. Cl.[5] ..... A63B 64/34

[52] U.S. Cl. ..... 482/83; 482/87

[58] Field of Search ..... 482/83-90, 482/148, 909; 273/55 R, 26 R

[56] References Cited

U.S. PATENT DOCUMENTS

| | | | |
|---|---|---|---|
| 808,528 | 12/1905 | Finneg et al. | 482/90 |
| 2,818,255 | 12/1957 | Ponza | 273/26 R |
| 4,175,744 | 11/1979 | Llewellyn | 273/26 E |
| 4,508,339 | 4/1985 | Llewelly | 273/26 E |
| 4,749,184 | 6/1988 | Tobin | 482/87 |
| 4,913,419 | 4/1990 | McAuliffe | 482/83 |
| 5,277,679 | 1/1994 | Wells | 482/83 |

*Primary Examiner*—Stephen R. Crow
*Assistant Examiner*—Jerome Donnelly
*Attorney, Agent, or Firm*—Risto A. Rinne, Jr.

[57] ABSTRACT

An improved striking device is provided as including a main post having two main longitudinal slots. An insert post having an outside diameter that is less than the inside diameter of the main post is provided. A striking surface is provided that is attached to an arm which in turn is attached to an arm housing. The arm housing has a first housing end and a second housing end. The arm housing is placed around the main post and the second housing end rests upon a support axle passing through the insert post. The first housing end includes a cam surface having two peaks located on opposite sides thereof and two valleys located on opposite sides thereof with each of the two valleys disposed between each of the two peaks. A cam follower is included which is retained in contact against the cam surface by a pair of springs. During rotation of the arm housing the cam follower cooperates with the cam surface of the arm housing to provide a first striking position and a second striking position that are each located one hundred and eighty degrees of rotation apart with respect to each other. As the arm housing rotates the cam surface extends the cam follower which is turn extends the pair of springs in proportion to the contour of the cam surface. If sufficient force is imparted to the striking surface, the arm housing is urged away from the first striking position, and indexes into the second striking position.

24 Claims, 5 Drawing Sheets

STRIKING DEVICE

BACKGROUND OF THE INVENTION

1. Field of the Invention

The present invention, in general, relates to apparatus used for training purposes by martial artists, boxers, and for other like types of sports and, more particularly, to training devices that are useful for striking.

Training devices that are used for striking are known. The most common of such devices is the punching bag. However the punching bag is limited for striking by a clenched fist and is not especially useful for striking by an open hand or by foot.

A training device that is suitable for striking at various heights above the floor surface by hand or by foot is a preferred type of striking device for martial arts training. Ideally the striking device should allow for the placement of the surface to be struck at any desired height and it should also return the surface being struck back to the original starting position during training activities (that impart moderate force) so that it may again be struck, as is common practice for repetitive forms of practice.

Furthermore, such devices should ideally have a means to register proportionally how much force has been imparted to the striking device whereby when a sufficient force has been imparted the striking device surface, it indexes from a first striking position to a second striking position. Ideally the device should also should include a means to vary the amount of force that is required to cause the indexing to a second striking position to occur that is in proper accordance with the size, age, and ability of the user.

Certain sports, such as golf, tennis, baseball, require striking a ball by a club, racket, or bat. A striking device that can readily be adapted for striking by a club, racket, or bat that is held by participant is a desirable device.

Other types of striking devices are known, however the types of mechanisms that are inherent with the prior devices vary the height of the surface being struck as movement of the striking surface occurs. It is desirable to maintain the same height of the striking surface above the floor surface even during movement of the striking surface.

Accordingly there exists today a need for a striking device that allows for a variable striking height by hand, by foot, or by club, maintains the height of the striking surface during movement, returns the striking surface back to the original starting position when moderate force is used, and includes an adjustable means to index the striking surface into a second position to indicate that a force in excess of a predetermined amount has been imparted to the striking surface.

2. Description of Prior Art

Martial arts, boxing, and other types of striking devices are known. For example, the following patents describe various types of these devices:

U.S. Pat. No. 808,528 to Finhey and Lantz, Dec. 26, 1905;

U.S. Pat. No. 1,287,176 to Armstrong, Dec. 10, 1918;

U.S. Pat. No. 2,818,255 to Ponza, Dec. 31, 1957;

U.S. Pat. No. 4,175,744 to Llewellyn, Nov. 27, 1979;

U.S. Pat. No. 4,508,339 to Llewellyn, Apr. 2, 1985;

U.S. Pat. No. 4,749,184 to Tobin, Jun. 7, 1988: and

Soviet Patent No. SU-423-479 to Agashin, November 1974.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a striking device that maintains the height of the striking surface as the striking surface moves upon being struck.

It is also an object of the invention to provide a striking device that allows for adjustment of the striking surface height above the surface upon which it is placed.

Another object of the invention is to provide a striking device that returns the striking surface back to the original starting position subsequent to each strike having less than a predetermined amount of force that is imparted to the striking surface.

Still another object of the invention is to provide a striking device that moves the striking surface to a second position subsequent to each strike having more than a predetermined amount of force that is imparted to the striking surface.

Yet another object of the invention is to provide striking device having a striking surface adapted for striking by hand, by foot, or by a club that is held by the user.

Yet another important object of the invention is to provide striking device having a striking surface that may be struck during offensive training.

Still yet a further important object of the invention is to provide striking device having a striking surface that may be struck during defensive training.

Still yet another important object of the invention is to provide striking device having a striking surface that can move in response to a strike coming from either direction.

Briefly, a striking device that is constructed in accordance with the principles of the present invention includes a main post having a top end and a bottom end and having two main longitudinal slots each of which extend substantially along the length of the main post and are located on opposite sides thereof. The bottom end of the main post is attached to a base that is placed on a surface. An insert post having a predetermined length that is shorter than the length of the main post and having an outside diameter that is less than the inside diameter of the main post is provided. The insert post has a first end and a second end. The first end includes a first longitudinal slot and a second longitudinal slot, each being located on opposite sides thereof and each being in alignment with the two main longitudinal slots when the insert post is properly placed inside of the main post. The insert post includes means useful for securing the insert post where desired along the longitudinal length of the main post. A striking assembly is provided that includes an arm housing, an arm attached at a first arm end to the arm housing and attached at a second arm end to a striking surface. The arm housing has an inside diameter that is greater than the outside diameter of the main post and is situated around a portion of the main post and also around a portion of the insert post simultaneously and includes a first housing end and a second housing end. A cam surface having two peaks located on opposite sides thereof and two valleys located on opposite sides thereof is provided on the first housing end. The second housing end bears against a support axle that passes through a pair of support axle holes that are provided in the insert post and also passes through a portion of the two main longitudinal slots. A cam follower is retained in contact against the cam surface by a pair of springs, each of which has a first spring end and a second spring end, the first spring end of each spring being attached to the cam follower and the second spring end of each spring being attached to a spring anchor which in turn is attachable to and removable apart from the insert post. The tension of the pair of springs is varied by placing the spring anchor in either closer to the first end of the insert post to achieve less tension or by placing the spring anchor away from the first end to achieve greater tension. According to a modification, a force gauge is provided attached to a modified insert post, that is useful to indicate how much tension is provided to the cam follower by the pair of springs. The support axle provides a bearing surface for the second housing end to bear upon as the housing arm is urged toward the support axle by the pair of springs. The support axle thus maintains the arm housing in position relative to the insert post and allows for rotation of the arm housing. During rotation of the arm housing the cam follower cooperates with the cam surface of the arm housing to provide a first striking position and a second striking position that are each located 180 degrees of rotation apart with respect to each other. In the first striking position a first end of the cam follower is in cooperation with a first valley of the cam surface and a second end of the cam follower is in cooperation with a second valley of the cam surface. The first arm end of the arm is attached to and extends away from the arm housing. The second arm end is attached to the striking surface. The length of the arm is predetermined for each striking device. When the striking surface is struck, the arm pivots in response causing the arm housing to rotate. As the arm housing rotates the cam surface extends the cam follower which in turn extends the pair of springs in proportion to the contour of the cam surface. The cam follower cooperates with the first and second longitudinal slots as it extends and retracts. If sufficient force is imparted to the striking surface, the arm housing is urged away from the first striking position, rotates in excess of ninety degrees, and indexes into the second striking position that is displaced one hundred and eighty degrees of arc rotation away from the first striking position. When the arm housing is indexed to the second striking position the first end of the cam follower is in cooperation with the second valley of the cam surface and a second end of the cam follower is in cooperation with the first valley of the cam surface. The arm housing remains at the same elevation during rotation of the arm housing from the first striking position into the second striking position. According to a modification, a modified insert post is provided as having a modified first end that is not adapted for cooperating with the slots of the main post. A modified main post is provided as including a plurality of pairs of main holes, each hole of each pair of main holes being located on opposite sides of the main post and at predetermined spaced apart locations along the length of the main post. Each pair of main holes periodically aligns with a corresponding pair of insert post holes that are provided in the modified first end of the modified insert post. A pin is placed simultaneously through one pair of modified main post holes and also through the modified insert post holes to secure the modified insert post in position.

DETAILED DESCRIPTION OF THE INVENTION

Figure 1:
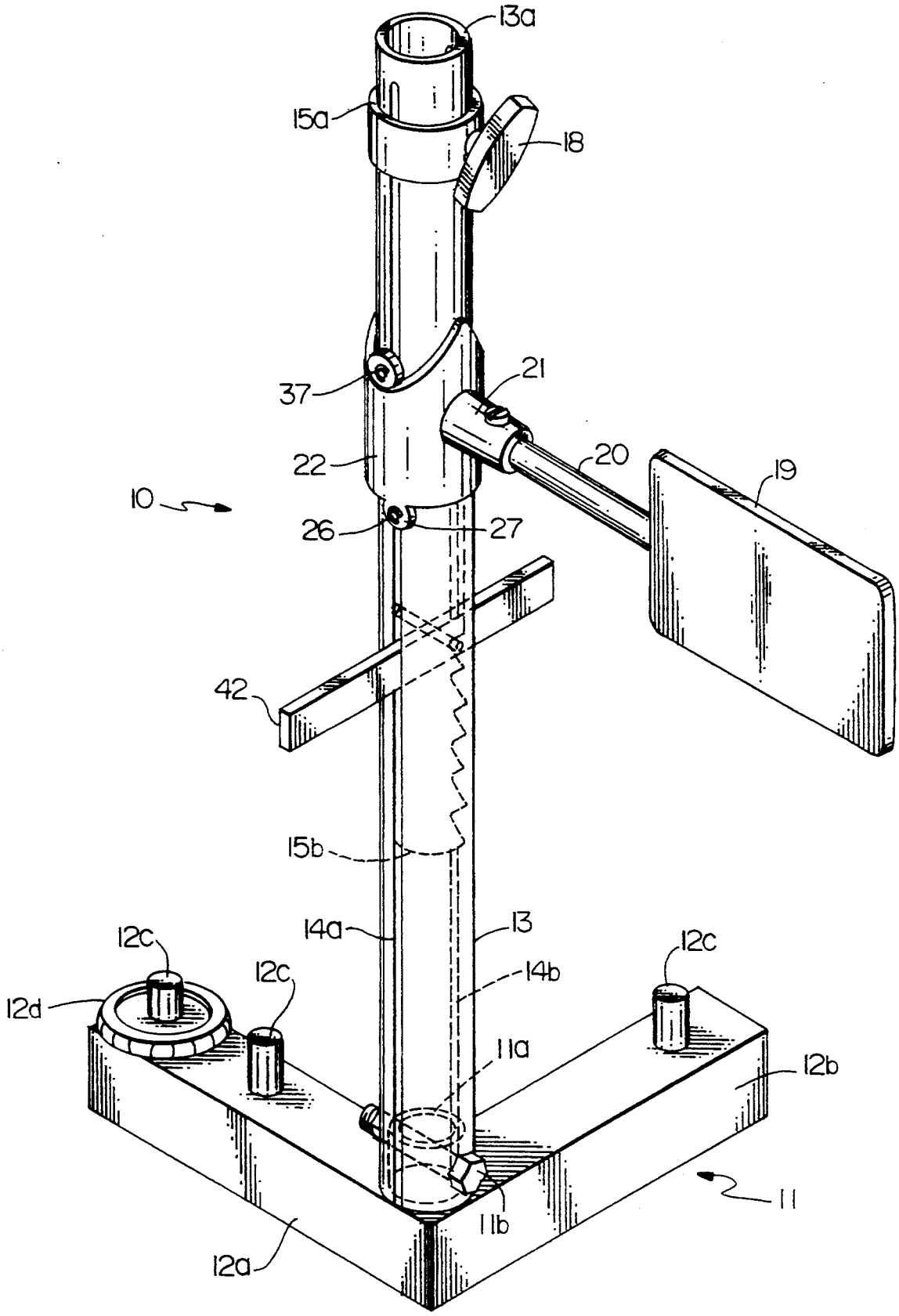
FIG. 1 is a view in perspective of a striking device.

Referring generally to FIG. 1 and, on occasion to all of the FIGURE drawings, is shown, an improved striking device, identified in general by the numeral 10.

A base assembly 11 is provided as including a main base post 11*a* that is adapted for attaching a main post 13 thereto. The main base post 11*a* includes a base bolt 11*b* that passes through a hole provided in the main post 13 and through a hole provided in the main base post 11*a*. The base bolt 11*b* is tightened to secure the main post 13 to the base 11 during use of the striking device 10, and allows for the removal of the main post 13 separate and apart from the base 11.

The base 11 as shown consists of a first base leg 12*a* and a second base leg 12*b*. The first base leg 12*a* is disposed on the same plane as the second base leg 12*b* and is also perpendicular thereto. A plurality of weight posts 12*c* are provided on the first and second base legs 12*a*, 12*b* that are adapted for receiving standard weights 12*d* as are commonly used by weight lifters.

The base 11 allows as many weights 12*d* to be placed thereon as is necessary to maintain the striking device 10 in the desired position on the floor (not shown) during use.

The first and second base legs 12*a*, 12*b* are positioned away from the user (not shown) who normally stands on the side of the striking device 10 that is opposite with respect to the first and second base legs 12*a*, 12*b* during use and therefore the first and second base legs 12*a*, 12*b* do not interfere with the training process.

A modified base (not shown) that includes a substantially flat rectangular plate is anticipated to replace the base 11 as desired. A second modified base (not shown) comprised of a plurality of legs extending radially away on a plane from a center point is also anticipated.

The main post 13 is formed of a predetermined length, thickness, and diameter of a suitable tubular material and includes a top end 13*a* and a bottom end 13*b*. The main post, according to a modification, is attached to the base 13 by male screw threads (not shown) provided in the bottom end 13*b* and female screw threads (not shown) that are provided in the base 13 which are adapted for cooperating with the male screw threads.

Extending through the main post 13 at the bottom end 13*b* and extending longitudinally to near the top end 13*a* are provided two main longitudinal slots 14*a*, 14*b*, each of which are located on opposite sides of the main post 13 and have a predetermined length and width.

An insert post 15 having a first end 15*a* and a second end 15*b* and having a predetermined length that is shorter than that of the main post 13 and having an outside diameter that is less than the inside diameter of the main post 13 is located inside the main post 13 and in longitudinal alignment thereof.

Located near to the first end 15*a* of the insert post 15 is a first longitudinal slot 16 and a second longitudinal slot 17. The first and second longitudinal slots 16, 17 are each formed of a predetermined length and width, the width of each being wider than the width of two main longitudinal slots 14*a*, 14*b*.

When the insert post 15 is slid longitudinally inside of the main post 13 and is properly oriented therein, the first and second longitudinal slots 16, 17 each align with one of the two main longitudinal slots 14*a*, 14*b*.

Figure 3:
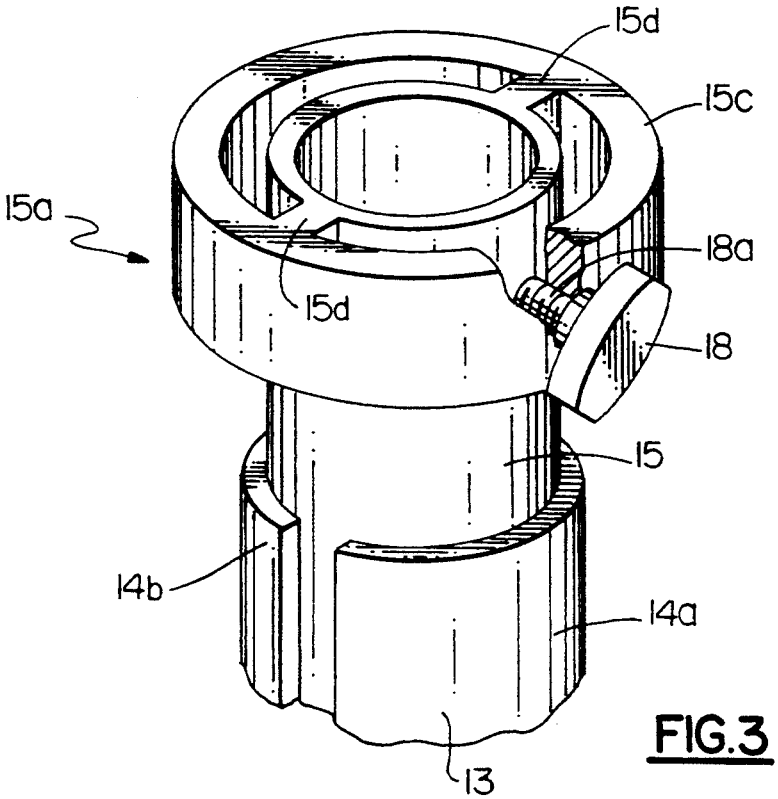
FIG. 3 is a view in perspective of a first end of an insert post of a preferred striking device.

Referring primarily to FIG. 3, the first end 15*a* of the insert post 15 is modified to form an outer ring 15*c* having a larger inside diameter than the outside diameter of the main post 13. The outer ring 15*c* is attached to the first end 15*a* by two ring members 15*d* each of which are located on opposite sides of the first end 15*a* and each of which are adapted to fit within the two main longitudinal slots 14*a*, 14*b* of the main post 13 and to cooperate with the two main longitudinal slots 14*a*, 14*b* of the main post 13 so that the insert post 15 may be slid anywhere within the main post 13 providing the two ring members 15*d* of the first end 15*a* are situated within the length as is defined by the two main longitudinal slots 14*a*, 14*b*.

A threaded hole (not shown) is provided in the first end 15*a* through which a screw handle 18 is inserted and is tightened or loosened. When the screw handle 18 is tightened, a screw portion 18*a* thereof bears against the outside of the main post 13 (A portion of the main post 13 is shown cut-away to reveal the screw portion 18*a*.), thereby securing the first end 15*a* thereto.

The screw handle 18 provides a method to secure the insert post 15 where desired along the length of the main post 13. This is useful for adjusting the height of a striking surface 19 that is attached to an arm 20 which in turn is attachable to, and removable apart from, an arm housing protrusion 21 that is attached to an arm housing 22. The location of the insert post 15, as is described in greater detail hereinbelow, defines the position as well of the arm housing 22, and therefore also of the striking surface 19 with respect to the longitudinal length of the main post 13.

Figure 2:
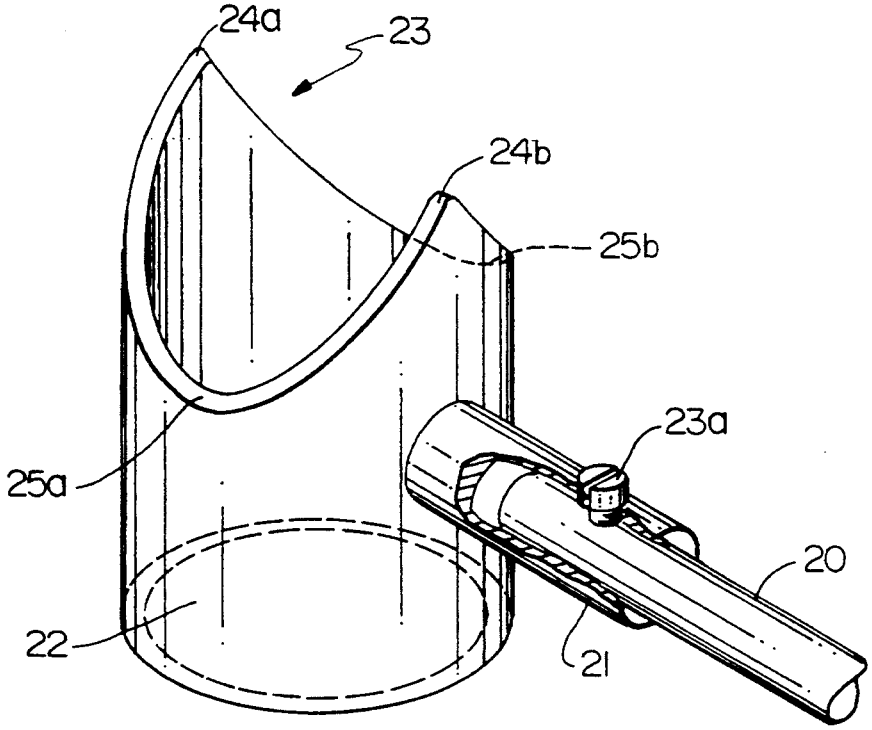
FIG. 2 is a view in perspective of an arm housing of a striking device.

Referring primarily to FIG. 2, the arm housing protrusion 21 attached to the arm housing 22 includes an arm screw 23 which engages with screw threads (not shown) that are provided in a hole in the arm housing protrusion 21. The arm screw 23 is tightened to secure and is loosened to remove the arm 20 from the arm housing protrusion 21. Various lengths and types of arms 20 are attached to the arm housing protrusion 21 as desired.

The arm housing 22 includes a cam surface, identified in general by the reference numeral 23, attached to a first housing end. The cam surface 23 includes two peaks 24*a*, 24*b* and two valleys 25*a*, 25*b* with each of the two peaks 24*a*, 24*b* disposed at opposite sides of the arm housing 22 and each of the two valleys 25*a*, 25*b* disposed between each of the two peaks 24*a*, 24*b*.

Referring again primarily to FIG. 1, the striking surface 19 is attached to the arm 20 at an end of the arm 20 opposite to where the arm 20 is attached to the arm housing protrusion 21 by screw type threads (not shown). The striking surface 19 preferably is constructed to provide a soft surface, such as energy absorbing foam type of pad, for striking by hand or by foot that is attached to a core (not shown) which in turn is attached to the arm 20.

The striking surface 19 is preferred for certain of the striking devices 10 to be detachable apart from the arm 20 and may be replaced by a modified striking surface (not shown) having certain desired characteristics, as is described in greater detail hereinbelow. However for certain embodiments of the striking device 10, the striking surface 19 is permanently attached to the arm 20.

The striking surface 19 includes a larger surface (not shown) for defensive types of practicing where the arms of the user are used to strike the striking surface 19. This is preferred to lessen bruising of the arm. A smaller striking surface 19 is often preferred when the fist or side of the palm of the user are used to strike the striking surface 19.

The elasticity of the striking surface 19 is varied to accommodate the needs of the user. For example a skilled user may prefer a stiffer striking surface 19 whereas a novice may prefer a more elastic softer type of striking surface 19.

The striking surface 19 is modified, as desired, to resemble any type of ball or object. For example, during practice of tennis strokes, the striking surface 19 is modified to resemble, both in shape and texture, a tennis ball (not shown). Accordingly it may be struck by a tennis racket held by the hands of the user. Similarly the striking surface 19 may be modified to resemble a baseball, golf ball, or the like. Any type of a club (not shown) is then used to strike the modified striking surface. The term club, as is used herein, refers in general to any type of a device that is held by the user and is used to strike the modified striking surface including, for example, a baseball bat, golf club, tennis racket, and other like types of clubs.

Referring again on occasion to all of the FIGURE drawings, a support axle 26 passes through a pair holes provided in the insert post 15 and includes two support axle bearings 27 attached at each end thereof and secured thereto by "E-clips" 28. The support axle 26 passes through both of the two main longitudinal slots 14*a*, 14*b*. Accordingly ,the support axle 26 is fixed in position relative to the insert post 15.

The support axle bearings 27 in cooperation with the support axle 26 and the insert post 15, provide a support surface adapted for supporting the arm housing 22 at a second housing end thereof. The arm housing 22 is able to rotate about the main post 13 and insert post 15 while bearing upon the support axle bearings 27.

Referring now primarily to FIG. 4 through FIG. 7, is shown a cam follower axle 29. The cam follower axle 29 includes a center relief 30 that is useful for securing in place thereto an upper spring anchor bracket (shown in dashed lines and identified by reference numeral 31 in FIG. 4). Attached to the upper spring anchor bracket 31 on each side thereof are a pair of springs 32 each of which are shown extended in FIG. 4, and therefore are under tension. The pair of springs 32 are each attached at a first end thereof to one side of the upper spring anchor bracket 31.

The cam follower axle 29 includes a smaller diameter axle first end 33 and a smaller diameter axle second end 34 as compared in general to the cam follower center portion 35. The cam follower center portion 35 is disposed between the axle first end 33 and the axle second end 34. The cam follower center portion 35 provides a raised surface that prevents movement of either of a pair of inner cam bearings 36 (FIG. 5) further towards the center of the cam follower axle 29.

The inner cam bearings 36 are adapted to engage with the first and second longitudinal slots 16, 17 and are able to extend longitudinally within the first and second longitudinal slots 16, 17 as the cam follower axle 29 is displaced therein, as is described in greater detail hereinbelow.

The inner cam bearings 36 are prevented from being displaced away from the center of the cam follower axle 29 and towards either the axle first or second ends 33, 34 by the width of the two main longitudinal slots 14*a*, 14*b*. The two main longitudinal slots 14*a*, 14*b* are each narrower in width than are the outside diameter of the inner cam bearings 36 and therefore maintain captive the inner cam bearings 36. The outside diameter of the inner cam bearings 36 are each somewhat less than is the width of the first and second longitudinal slots 16, 17 so that they may fit therein.

The inner cam bearings 36 must be maintained within the space as is defined by the first and second longitudinal slots 16, 17 in order to maintain cooperation of the cam follower axle 29 with the first and second longitudinal slots 16, 17 as the cam follower axle 29 is therein extended.

Attached to the cam follower axle 29 at the axle first and second ends 33, 34 are two outer cam follower bearings 37. The outer cam follower bearings 37 are prevented from being further displaced towards the center of the cam follower axle 29 by the two main longitudinal slots 14*a*, 14*b*, each of which is narrower in width than is the outside diameter of either of the two outer cam follower bearings 37. A pair of cam follower "E-clips" 38 are attached to cam follower axle 29 at a pair of clip recesses 39 and are used to secure the outer cam follower bearings 37 to the cam follower axle 29.

Figure 4:
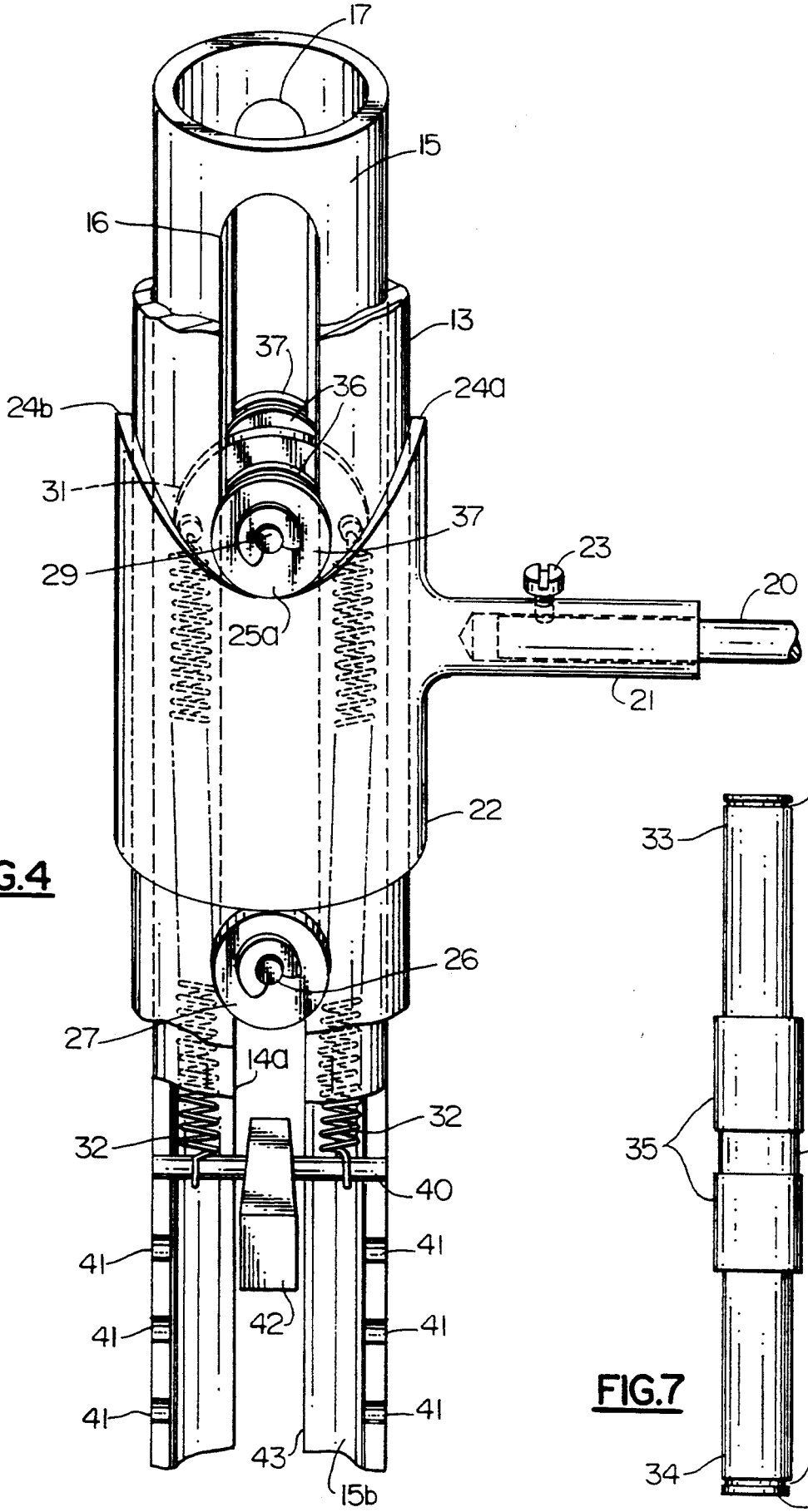
FIG. 4 is a view in perspective of a portion of a preferred striking device.
Figure 7:
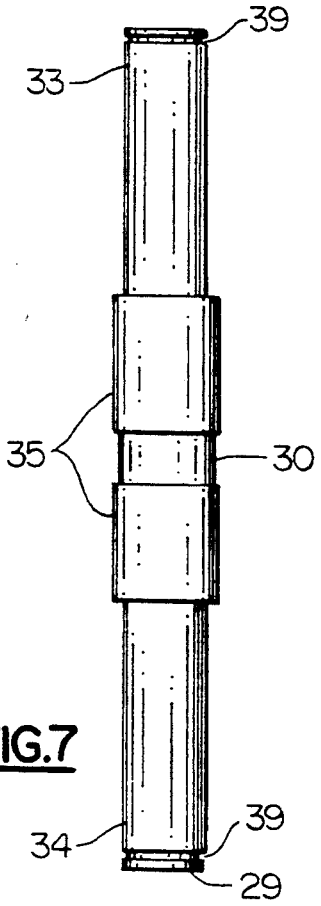
FIG. 7 is a side elevational view of a cam follower axle.
Figure 5:
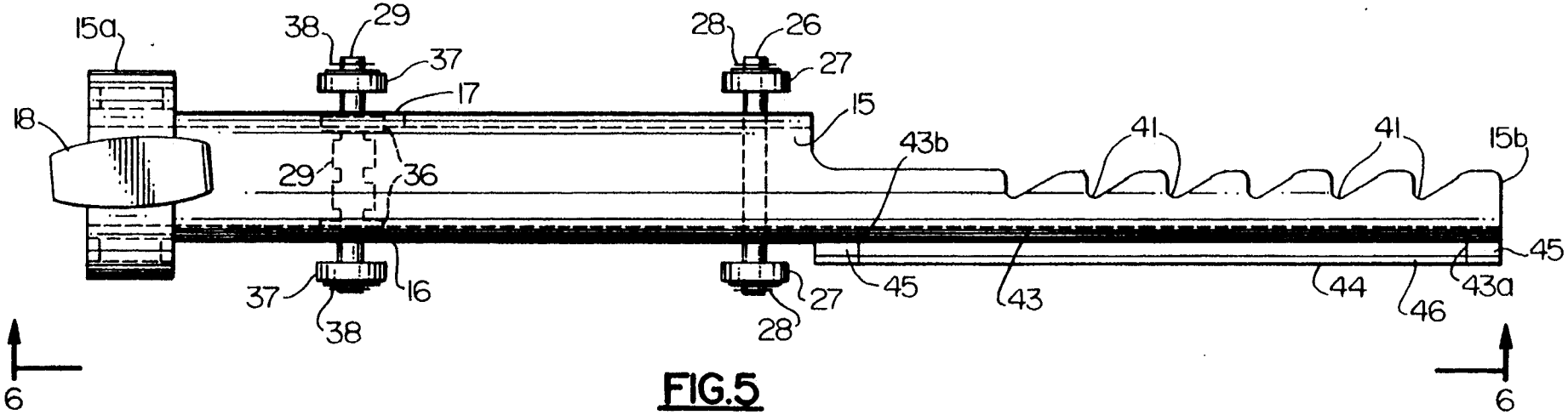
FIG. 5 is a side elevational view of an insert post.

Referring momentarily to FIG. 4 and to FIG. 5, the pair of springs 32 are each attached at a second end thereof to a lower spring anchor bracket 40. The lower spring anchor bracket 40 is comprised of a shaft that is adapted to engage with one pair of a plurality of notch pairs 41 that are provided in the insert post 15.

The first of a plurality of notch pairs 41 are disposed near to where the support axle 26 passes through the insert post 15, with each notch pair of each of the plurality of notch pairs 41 being in substantial parallel alignment with each other. Therefore each notch of each notch pair of the plurality of notch pairs 41 is equidistant from the insert post first end 15*a*.

Each pair of the plurality of notch pairs 41 is disposed at a spaced apart relationship along a face that is provided approximately along the diameter of the insert post 15 and extending longitudinally to the second end 15*b* thereof.

A tension arm 42 is provided pivotally attached about the lower spring anchor bracket 40 and is used to apply a force to extend or to retract the pair of springs 32, as desired. The pair of springs 32 are extended or retracted by pivoting the tension arm 42 so that it protrudes out of both of the two main longitudinal slots 14*a*, 14*b* where it may then be grasped by the user and pulled. After adjustment, the tension arm 42 is pivoted so that it extends longitudinally within the main post 13 where it can not be contacted during use of the striking device 10.

According to a modification, a pair of energy absorbing grip handles (not shown) are placed over one or over both ends of the tension arm 42 during assembly. The energy absorbing grip handles help to prevent injury to the user should he accidentally strike the tension arm 42 during training. They also prevent the tension arm 42 from being pivoted longitudinally within the main post 13.

The energy absorbing grip handles are also useful in determining which pair of the plurality of notch pairs 41 is engaged by the lower spring anchor bracket 40, as is described in greater detail hereinbelow. The energy absorbing grip handles are formed of either a foam or a rubber or other type of energy absorbing material with a hole provided in each that is designed to allow each of the energy absorbing grip handles to slip over the end of the tension arm 42.

Figure 6:
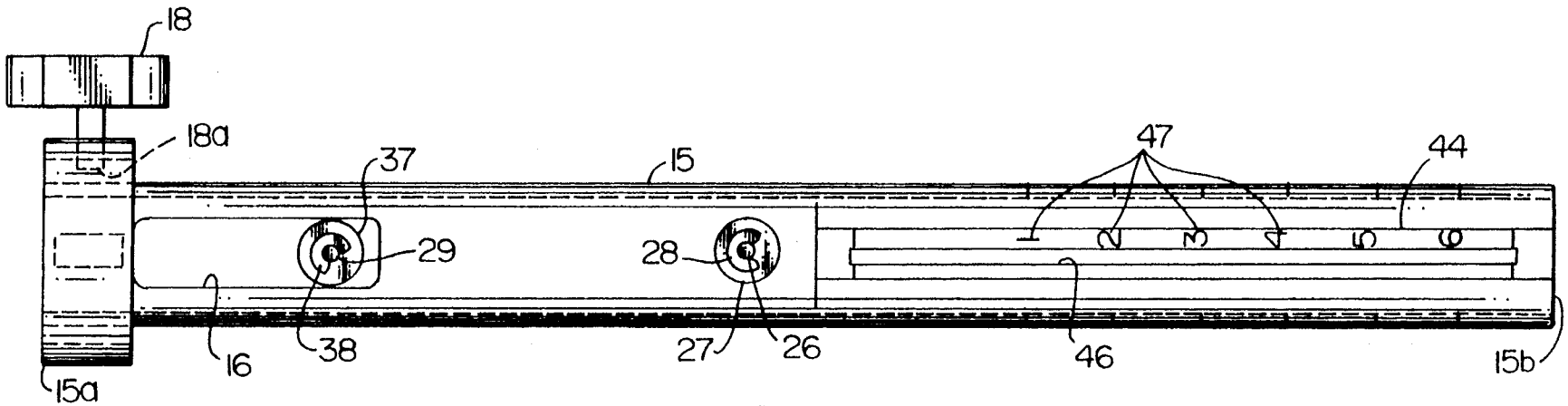
FIG. 6 is an elevational view of the insert post shown in FIG. 5 as seen along the line 6—6 therein.

Referring now primarily to FIG. 4 through FIG. 6, a lower slot 43 is longitudinally provided in the insert post 15 and is disposed with one slot end 43*a* located near to the second end 15*b*. The lower slot 43 extends along the insert post 15 between each notch of each of the plurality of notch pairs 41 for approximately the length of the plurality of notch pairs 41 and is also in alignment with one of the main longitudinal slots 14*b* when the insert post 15 is properly oriented within the main post 13. The remaining slot end 43*b* is located near to where the support axle 26 passes through the insert post 15. The lower slot 43 is provided to allow pivoting of the tension arm 42 to occur.

According to a modification, an elevated force gauge 44 is shown in FIG. 5 and FIG. 6 and is attached to the insert post 15 so as to be in general alignment with the lower slot 43. The force gauge 44 is elevated above the lower slot 43 by a pair of posts 45 that protrude out from the insert post 15 a predetermined amount.

The force gauge 44 and the pair of posts 45 are narrower in width than is the width of one of the two main longitudinal slots 14*a* so that they may protrude from the insert post 15 and extend into a portion of the space that is defined by one of the two main longitudinal slots 14*a* without causing a mechanical interference with one of the two main longitudinal slots 14*a*.

The force gauge 44 includes a clearance slot 46 that is approximately the same size and shape as is the lower slot 43 and is general alignment therewith. The clearance slot 46 is provided to allow for pivoting and for extension of the tension arm 42 to occur when the force gauge 44 is included as a part of the insert post 15.

According to another preferred modification, a modified force gauge (not shown) is provided wherein the posts 45 are eliminated and the modified force gauge is included in a cast type of insert post (not shown) as a cast protrusion (not shown) that extends longitudinally on a portion of the cast type of insert post. A slotted end (not shown) is provided in the end of the cast protrusion that is included as a part of the cast type of insert post.

When a casting process is employed, the cast type of insert post is the preferred way to provide for a visible force gauge 44. The cast protrusion extends into a portion of the space that is defined by one of the two main longitudinal slots 14a without causing a mechanical interference with one of the two main longitudinal slots 14a.

The force gauge 44 includes reference markings 47 that are visible on one surface thereof and which are useful for indicating which pair of notches of the plurality of notch pairs 41 are engaged by the lower spring anchor bracket 40, and therefore, also what degree of tension is experienced by the pair of springs 32.

The reference markings 47 are used by visually sighting simultaneously across both of the two main longitudinal slots 14a, 14b, and by observing the position of the lower spring anchor bracket 40.

Alternatively, either a modified lower spring anchor bracket (not shown) or a modified tension arm (not shown) are provided which include a mechanical protrusion (not shown) extending therefrom which functions as a reference pointer that is visible extending through the clearance slot 46 adjacent to the reference markings 47 when the modified tension arm is pivoted into longitudinal alignment with the main post 13.

When the energy absorbing grip handles are used over the tension arm 42, the top or bottom surfaces of the energy absorbing grip handles provide a visual reference to indicate the relative position of the tension arm 42 with respect to the reference markings 47.

The elevated force gauge 44 provides a convenient method useful to determine the tension setting of the pair of springs 32 that is effective for any desired position of the insert post 15 within the main post 13. Accordingly, as the insert post 15 is moved longitudinally within the main post 13, the elevated force gauge 44 and the pair of posts 45 extend partially into one of the two main longitudinal slots 14a. The force gauge 44 remains visible through one of the two main longitudinal slots 14a along the length of the main post 13.

According to a modification, a modified insert post (not shown) is provided as having modified first end that is not adapted for cooperating with the slots of the main post. A modified main post (not shown) is provided as including a plurality of pairs of main holes, each hole of each pair of main holes being located on opposite sides of the modified main post and at predetermined spaced apart locations along the length of the modified main post.

Each pair of main holes periodically aligns with a corresponding pair of insert post holes that are provided in the modified first end of the modified insert post when the modified insert post is placed within the modified main post so that the first and second longitudinal slots are in alignment with the two main longitudinal slots and as the modified insert post is moved longitudinally within the modified main post. A pin (not shown) is placed simultaneously through one pair of modified main post holes and also through the modified insert post holes and is used to secure the modified insert post in position within the main post as defined by the spaced apart location separating each of the pairs of modified main post holes, and accordingly, provides another method useful to adjust the height the modified insert post.

Operation

When the tension arm 42 is grasped and is pulled in a direction that is generally away from the first end 15a of the insert post 15, the lower spring anchor bracket 40 slides along the inclined surface that is included in the formation of each notch of the plurality of notch pairs 41 until it is removed from a position of cooperation with one of the pairs of the plurality of notch pairs 41.

If greater tension to the pair of springs 32 is desired, the tension arm 42 is first pulled in a direction that is generally away from the first end 15a to release the lower spring anchor bracket from a position of cooperation with one of the plurality of notch pairs 41. The tension arm 42 is then pulled further away from the first end 15a to the extent desired and is then released so as to cause the lower spring anchor bracket 40 to engage with a pair of the plurality of notch pairs 41 that is located further away from the first end 15a from where it was removed.

Applying a slight pressure to the tension arm 42 generally towards the plurality of notch pairs 40 is sufficient to ensure engagement of the lower spring anchor bracket 40 with one of the plurality of notch pairs 41.

If less tension to the pair of springs 32 is desired, the tension arm 42 is first pulled in a direction that is generally away from the first end 15a to release the lower spring anchor bracket 40 from a position of cooperation with one of the plurality of notch pairs 40. The tension arm 42 is then retracted until the desired position is obtained at which time the tension arm 42 is released in the manner described hereinabove so as to cause the lower spring anchor bracket 40 to engage with a pair of the plurality of notch pairs 41 that is located closer towards the first end 15a than from where it was removed.

When greater tension is applied to the pair of springs 32, the pair of springs 32 urge the two outer cam follower bearings 37 of the cam follower axle 29 to bear with greater force upon each of the two valleys 25a, 25b and generally to the cam surface 23 when the arm housing 22 is rotated.

When less tension is applied to the pair of springs 32, the pair of springs 32 urge the two outer cam follower bearings 37 of the cam follower axle 29 to bear with less force upon each of the two valleys 25a, 25b and generally to the cam surface 23 when the arm housing 22 is rotated.

When a greater force is applied by the pair of springs 32 to the two valleys 25a, 25b and also in general to the cam surface 23 the resistance experienced by the arm housing 22 increases as it is rotated. This is caused by the cam surface 23 extending further the pair of springs 32 when the arm housing 22 is rotated.

As the arm housing 22 is rotated, the two outer cam follower bearings 37 bear upon the cam surface 23 causing the cam follower axle 29 to be extended longitudinally within the space defined by the first and second longitudinal slots 16, 17. As the cam follower axle 29 is extended further, the pair of springs 32 are also extended further which in accordance with the spring constant that is selected for the pair of springs 32, increases the resistance to rotation that is experienced by the arm housing. Accordingly, a greater force is required to rotate the arm housing 22. The greater force is supplied when a greater force is imparted to the striking surface 19.

When a modest force is imparted to the striking surface 19, the arm housing 22 is rotated less than ninety degrees of arc rotation away from a first striking position. In the first striking position, each of the two outer cam follower bearings 37 bear upon each of valleys 25a, 25b of the cam surface 23.

Less than ninety degrees of rotation by the arm housing 22 prevents the two outer cam follower bearings 37 from reaching the two peaks 24*a*, 24*b* of the cam surface 23. Accordingly, the rotation of the arm housing 22 stops momentarily as the pair of springs 32 then begin to urge the two outer cam follower bearings 37 to bear down upon the cam surface which in turn urges the arm housing 22 to rotate in a direction opposite to the direction the arm housing 22 rotated in response to being struck until the arm housing 22 rotates back into the first striking position.

When an even greater force is imparted to the striking surface 19, the arm housing 22 is rotated more than ninety degrees of arc rotation away from the first striking position. More than ninety degrees of rotation by the arm housing results in having the two outer cam follower bearings 37 pass over the two peaks 24*a*, 24*b* of the cam surface 23.

Accordingly rotation of the arm housing 22 continues as the pair of springs 32 continue to urge the two outer cam follower bearings 37 to bear down upon the cam surface which in turn cause the arm housing 22 to continue to rotate in the same direction into a second striking position wherein the arm housing 22 has rotated approximately one hundred and eighty degrees of arc rotation.

In the second striking position, each of the two outer cam follower bearings 37 bear upon opposite of each of the valleys 25*a*, 25*b* of the cam surface 23 as compared to the first striking position. This results in indexing the striking surface 19 into the second striking position and provides indication that a greater force has been imparted to the striking surface 19.

When the lower spring anchor bracket 40 is positioned in one of the plurality of notch pairs 41 that is closer to the first end 15*a*, less force is applied by the pair of springs 32 to the two valleys 25*a*, 25*b* and generally to the cam surface 23. Less force in turn decreases the resistance that is experienced by the arm housing 22 when it is rotated. Accordingly a lesser force is required to rotate the arm housing 22 either within the first striking position or to rotate the arm housing 22 from the first striking position into the second striking position. The lesser force is supplied when a lesser force is being imparted to the striking surface 19.

The use of the tension arm 42 to select which pair of the the plurality of notch pairs 40 is engaged by the lower spring anchor bracket 40 provides a method that useful to establish the resistance to rotation that is experienced by the arm housing 22. This is desirable when users of varying ability strike the striking surface 19 of the improved striking device 10 and for varying the resistance to rotation for defensive types of training as compared to offensive types of training. Similarly, varying the resistance to rotation by the arm housing 22 is useful when the striking device is struck by a club (not shown).

As the arm housing 22 rotates, either within the first striking position or from the first striking position into the second striking position, or if the striking surface 19 is struck sufficiently hard while in the second striking position to cause the arm housing 22 to index back into the first striking position, the second end of the arm housing 22 continues to bear against the two support axle bearings 27 throughout all of the rotation that is experienced by the arm housing 22.

This is because the pair of springs 32 continue to apply a force to the cam follower axle 29, and therefore to the two outer cam follower bearings 37 which then bear upon the cam surface 23 with sufficient force necessary to maintain the second end of the arm housing 22 in contact with the two support axle bearing 27 during rotation of the arm housing 22.

Accordingly the striking surface 19 remains at the same elevation (level) with respect to the surface (not shown) upon which the base 11 is placed as the arm housing 22 rotates. The cam follower axle 29 is extended and is retracted during rotation of the arm housing 22 within a portion of the two main longitudinal slots 14*a*, 14*b* of the main post 13 and also within a portion of the space that is defined by the first and second longitudinal slots 16, 17 of the insert post 15.

The initial height of the striking surface 19 is established by loosening the screw handle 18, by sliding the insert post 15 longitudinally within the main post 13 until the proper height is achieved for the striking surface 19. The screw handle 18 is then tightened to maintain the striking surface 19 at the preferred elevation during training.

A modification that is anticipated for the striking device 10 includes the use of multiple insert assemblies, each insert assembly comprised of, at a minimum, the insert post 15, arm housing 22, arm housing protrusion 21, arm 20, support axle 26, support axle bearings 27, cam follower axle 29, inner cam bearings 36, outer cam follower bearings 37, lower spring anchor bracket 40, anchor bracket 31, pair of springs 32, striking surface 19, and a method to secure each insert assembly in the desired position within the main post 13.

The multiple insert assemblies are simultaneously placed where desired within the main post 13 and are secured thereto by any of the methods as described hereinabove. The use of multiple insert assemblies provides for a plurality of striking surfaces disposed at various elevations above the base 11 that are useful for more advanced types of training programs.

A similar type of modification includes the use of a plurality of arm housing protrusions 21 attached to and extending in a predetermined direction from a modified arm housing (not shown). Attached where desired to the plurality of arm housing protrusions 21 are a plurality of arms 20, with each arm 20 including at least one striking surface 19 attached thereto. The use of multiple striking surfaces 19 and arms 20 attached to each modified arm housing provides for a plurality of striking surfaces 19 disposed at similar elevations that are also useful for more advanced types of training programs.

Of course, multiple insert assemblies are disposed within the main post 13, as desired and with certain of the multiple insert assemblies including the modified arm housing. Accordingly certain of the multiple insert assemblies will include a plurality of arm housing protrusions 21, a plurality of arms 20, and a plurality of striking surfaces 19 attached thereto to each of the modified arm housings to provide for the maximum challenge during training.

Another modification includes the use of a cam cover (not shown) that is placed over the arm housing 22 and is fastened thereto. The cam cover extends over the cam surface 23 and over the support axle 26 thereby providing a more finished appearance to the striking device 10 and also preventing contact with either the cam surface 23, cam follower axle 29, or the support axle 26 during training.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

Figure 8:
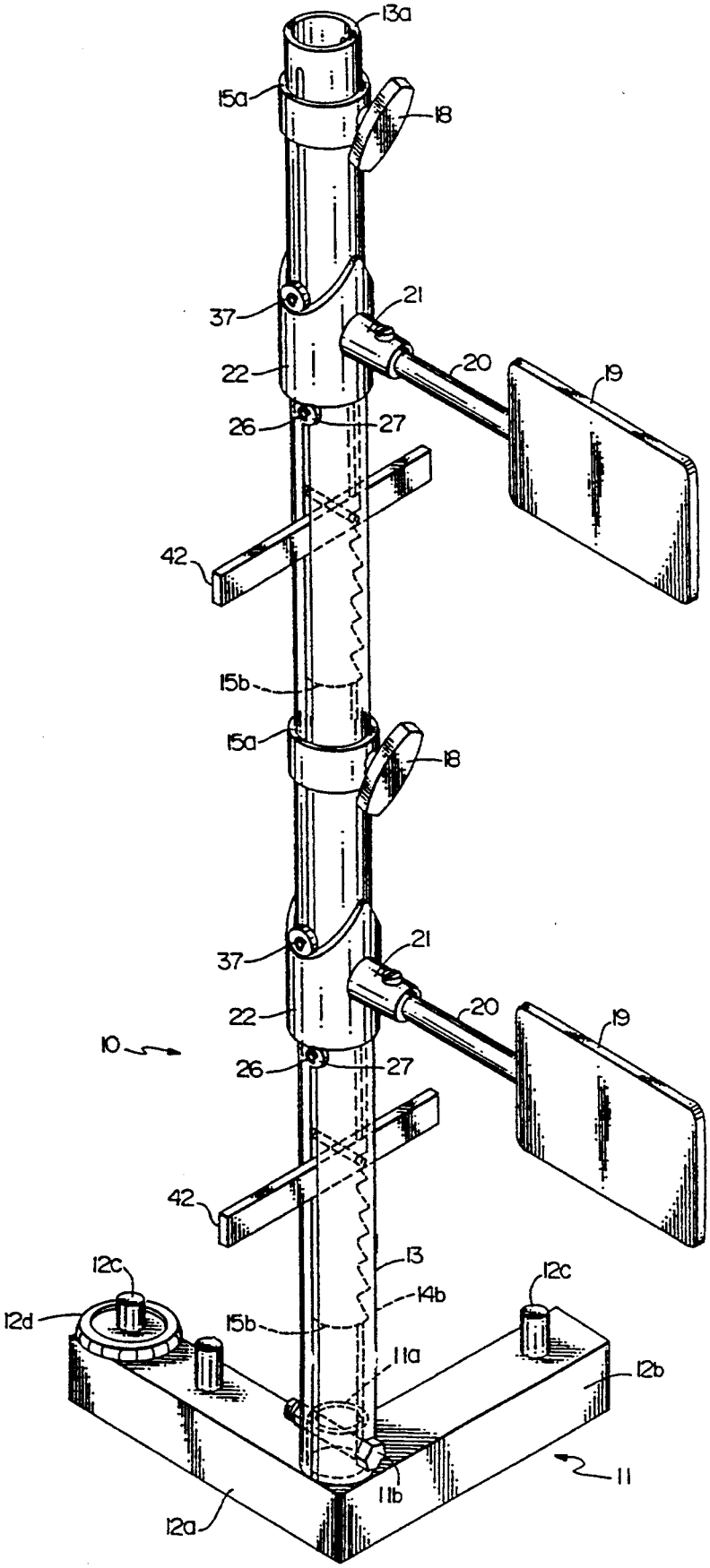
FIG. 8 is a view in perspective of a striking device showing a plurality of insert posts and a plurality of arms attached thereto.

Referring to FIG. 8 is shown the striking device with a plurality of insert posts 15 contained within the same main post 13. Accordingly a plurality of arm housings 22 with a plurality of arms 20, and a plurality of striking surfaces 19 are attached. This permits optimum practice to occur by striking at different elevations simultaneously with a variety of striking surfaces 19 available at each elevation.

Of course a plurality of arms 20 may be attached to any one arm housing 22 without the need for a plurality of insert posts 15 to permit the striking of a variety of striking surfaces 19 at one elevation generally. Similarly, a plurality of insert posts 15 having arm housings 22 that do not have a plurality of arms 20 attached to certain of the arm housing 22 is anticipated for practice at various elevations, but when only one striking surface 19 is desired at certain of the elevations selected.

A cam cover 48 is attached over the top arm housing 22 to prevent contact with the cam surfaces. The cam cover 48 as shown is a friction fit although other methods of attaching the cam cover 48 are anticipated as well as longer cam covers (not shown) which extend down beyond the longitudinal length of the arm housing 22 thereby covering it fully, if desired.

What is claimed is:

1. A striking device useful for training, comprising:

(a) base means;

(b) main post means attached at one end thereof to said base means and extending generally in an upward direction therefrom;

(c) insert post means adapted for insertion in said main post means, said insert post means able to be disposed within said main post means along a longitudinal axis thereof;

(d) means to secure said insert post means where desired along said longitudinal axis;

(e) arm housing means adapted to fit over said main post means, said arm housing means having cam surface means attached at a first housing end and having bearing surface means at a second housing end thereof;

(f) said cam surface means having two peaks and two valleys with each of said two peaks being disposed at opposite sides of said first housing end and each of said two valleys being disposed between each of said two peaks and at opposite sides thereof;

(g) arm means attached to said arm housing means and extending a predetermined distance therefrom;

(h) striking surface means attached to said arm means at an end of said arm means opposite to where said arm means is attached to said arm housing means;

(i) cam follower means having a first cam follower means end and a second cam follower means end, said cam follower means including means to maintain cooperation of said cam follower means with said insert post means wherein said means to maintain cooperation of said cam follower means with said insert post means includes bearing means attached to said cam follower means and said insert post means includes insert post slot means, said insert post slot means being adapted for cooperation with said bearing means;

(j) spring means attachable to said insert post means at one end of said spring means and attached to said cam follower means at the remaining end of said spring means, said spring means applying a force sufficient to maintain said cam follower means in a position of cooperation with said cam surface means and to cause said cam follower means to apply a force sufficient to rotate said arm housing means to a first striking position wherein said first cam follower means end is disposed substantially in a position of cooperation with one of said two valleys and said second cam follower means end is disposed substantially in a position of cooperation with a remainder of said two valleys; and (k) support axle means passing through a pair of holes provided in said insert post means, said support axle means providing means for maintaining said arm housing means in a relative position of cooperation with respect to said insert post means;

whereby when said striking surface means is struck by a force that is insufficient to rotate said arm means in excess of ninety degrees with respect to said main post means, said cam follower means is able to apply a force to said cam surface means sufficient to rotate said arm housing means back to said first striking position, and when said striking surface means is struck by a force that is sufficient to rotate said arm means in excess of ninety degrees with respect to sad main post means, said cam follower means is able to apply a force to said cam surface means sufficient to rotate said arm housing means to a second striking position wherein said first cam follower means end is disposed substantially in a position of cooperation with said remainder of said two valleys and said second cam follower means end is disposed substantially in a position of cooperating with said one of said two valleys, and said arm housing means is maintained in the same position with respect to said longitudinal length of said main post means when said arm means is rotated from said first striking position to said second striking position.

2. The striking device of claim 1 wherein said base means includes base plate means.

3. The striking device of claim 1 wherein said base means includes base leg means extending radially away from said one end thereof of said main post means.

4. The striking device of claim 1 wherein said means to secure said insert post means includes a first end means of said insert post means that is adapted for cooperating with said pair of longitudinal slots provided in said main post means and includes handle screw means attached to said first end means for bearing against said main post means thereby securing said insert post means thereto.

5. The striking device of claim 1 wherein said means to secure said insert post means includes hole means provided in said main post means at predetermined spaced apart locations and insert post hole means provided in said insert post means adapted for cooperating with said hole means provided in said main post means when said insert post hole means is property aligned with said hole means provided in said main post means, and including pin means of inserting through said hole means and through said insert post hole means for securing said insert post means in a position of cooperation with respect to said main post means.

6. The striking device of claim 1 wherein said main post means includes an inside diameter and an outside diameter and is of a predetermined length having said two main longitudinal slots each of which extend substantially along the length of the main post means and each of which are located substantially on opposite sides thereof.

7. The striking device of claim 6 wherein said insert post means is formed of a predetermined length that is shorter than said predetermined length of said main post means and has an outside diameter that is less than said inside diameter of said main post means and includes a first end and a second end.

8. The striking device of claim 7 wherein said first end of said insert post means is adapted for cooperating with said two main longitudinal slots to secure said insert post means where desired along said longitudinal axis of said main post means.

9. The striking device of claim 7 wherein said second end of said insert post means includes notch means, wherein said notch means is adapted for securing said remaining end of said spring means thereto.

10. The striking device of claim 9 wherein said notch means includes a pair of notch means, said pair of notch means being disposed on said second end of said insert post means at a spaced apart relationship and being in alignment with each other.

11. The striking device of claim 9 wherein said notch means includes a plurality of notch means.

12. The striking device of claim 1 wherein said arm means is attachable to and removable apart from said arm housing means.

13. The striking device of claim 1 wherein said cam follower means includes cam follower bearing means attached to said cam follower means and being adapted for cooperating with said cam surface means.

14. The striking device of claim 1 wherein said spring means includes a plurality of spring means.

15. The striking device of claim 1 wherein said support axle means includes thrust bearing means adapted for cooperating with said bearing surface means of said arm housing means.

16. The striking device of claim 1 wherein said striking surface means includes means adapted for attaching said striking surface means to and removing said striking surface means apart from said arm means.

17. The striking device of claim 1 wherein said striking surface means includes striking surface means adapted for striking during offensive training.

18. The striking device of claim 1 wherein said striking surface means includes striking surface means adapted for striking during defensive training.

19. The striking device of claim 1 wherein said striking surface means includes striking surface means adapted for striking by club means.

20. The striking device of claim 1 wherein said insert post means includes force gauge means attached thereto for indicating the tension of said spring means.

21. The striking device of claim 1 wherein said insert post means includes a plurality of insert post means disposed in a spaced apart relationship with respect to each other longitudinally within said main post means.

22. The striking device of claim 1 wherein said arm housing means includes a plurality of arm means attached to each of said arm housing means, each of said plurality of arm means including striking surface means attached to an end of said each of said plurality of arm means opposite to where said each of said plurality of arm means is attached to said arm housing means.

23. The striking device of claim 1 including cam cover means, said cam cover means attached to said arm housing means and extending over said cam surface means to provide a covering thereof.

24. The striking device of claim 1 wherein said base means includes post means adapted for receiving weight means that is useful for maintaining said striking device in a predetermined position during use.

* * * * *